US005711751A

United States Patent [19]

Harmanoglu

[11] Patent Number: 5,711,751

[45] Date of Patent: Jan. 27, 1998

[54] HERMETIC SEAL FOR A PLASTIC BAG

[76] Inventor: Hikmet Harmanoglu, 179 Morgan Ave., Brooklyn, N.Y. 11237

[21] Appl. No.: 498,085

[22] Filed: Jul. 5, 1995

[51] Int. Cl.[6] ..... B31B 1/90

[52] U.S. Cl. ..... 493/224; 493/194; 493/212; 493/927; 493/232; 493/239

[58] Field of Search ..... 493/210, 212, 493/213, 220, 223, 224, 232, 237, 239, 927

[56] References Cited

U.S. PATENT DOCUMENTS

| | | | |
|---|---|---|---|
| 3,561,670 | 2/1971 | Segal | 493/210 |
| 4,913,693 | 4/1990 | Ball | 493/223 |
| 4,932,791 | 6/1990 | Vetter | 383/93 |
| 5,045,040 | 9/1991 | Vetter | 493/194 |
| 5,049,118 | 9/1991 | McNabb | 493/210 |
| 5,273,514 | 12/1993 | Kristensen | 493/210 |

*Primary Examiner*—Jack W. Lavinder
*Attorney, Agent, or Firm*—Myron Amer PC

[57] ABSTRACT

A plastic bag manufacturing method to produce bags with a removable release strip in covering relation over an adhesive deposit adjacent an upper edge of the bag rear panel, in which the height of the release strip is increased to provide continuity along the length thereof to enable urging the strip, as required during the bag manufacturing process, in a machine direction, and the lower release strip portion is notched at locations coinciding with the bag side edges so that these bag side edges are fused for their entire lengths with no inhibiting of this fusing process by the release strip being in an interposed position between the overlying upper edges of the bag front and rear panels.

1 Claim, 2 Drawing Sheets

HERMETIC SEAL FOR A PLASTIC BAG

The present invention relates generally to the manufacture of plastic bags providing a hermetic seal, and more particularly to a hermetic seal which extends across the entire width of the bag which is of a desired type advantageously using a removable release strip.

EXAMPLE OF THE PRIOR ART

A hermetic seal is effectively embodied in a plastic bag using a horizontally oriented adhesive deposit across the top of the bag rear panel which, when contacted by the overlying top of the bag front panel, closes the opening into the bag to an extent which meets commercial requirements qualifying as a hermetic seal. The adhesive function as just noted must, of course, be delayed until after contents are placed in the bag and, as should be readily appreciated, also delayed during the manufacture of the bag. This delay or forestalling of the adhesive function is achieved using a so-called release strip which is positioned over the adhesive deposit and peeled therefrom incident to permitting the adhesive function.

Plastic bag manufacture with hermetic seal capability is already known, as exemplified by U.S. Pat. No. 4,932,791 issued to Kurt W. Vetter on Jun. 12, 1990 for "Envelope Closure Seal and Method". As to be noted from the Vetter patent and all other known patents pertinent to hermetically sealing plastic bags, the release strip which forestalls the adhesive function also unavoidably extends between the tops of the bag front and rear panels and in crossing relation above the locations at which the panels are heat sealed to each other to provide opposite sealed sides to the bag. The release strip in its interposed position between the top edges of the front and rear panels inhibits heat sealing along the top length portions of the sides of the bag and, as a consequence, the unsealed upper edges of the bag can be inadvertently pulled in a direction delaminating or separating the fused sides of the bag and thus causing loss of the hermetic seal thereof.

Broadly, it is an object of the present invention to provide plastic bags with hermetic seal capability overcoming the foregoing and other shortcomings of the prior art.

More specifically, it is an object to embody both full heat sealed side edges and a removable release strip in economically manufactured plastic bags, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
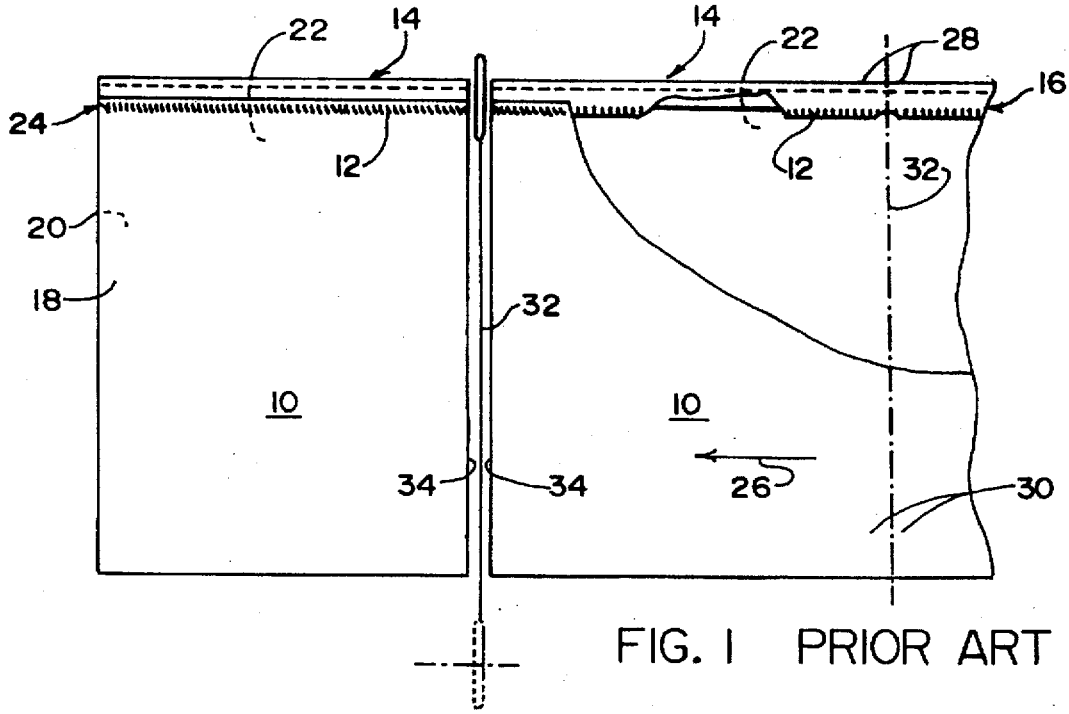
FIG. 1 PRIOR ART
FIG. 1 is a front elevational view demonstrating a prior art method of forming plastic bags in side by side relation.

As is well known, and exemplified by U.S. Pat. No. 4,932,791 issued to Kurt W. Vetter on Jun. 12, 1990 and illustrated in the present application FIGS. 1 and 3, is a method of successively forming in side by side relation plural bags 10 each of a type having a widthwise oriented adhesive deposit 12 with a release strip 14 in covering relation thereover and in an interposed position, as best depicted in FIG. 3, between overlying upper edges 16 of a bag front panel 18 and a bag rear panel 20 bounding an opening 22 into the bag 10 wherein removal of the release strip 14 is adapted to provide an adhesive closure 24 for the bag opening 22.

As described in U.S. Pat. No. 4,932,791, and well known, in the forming of the successive plastic bags 10, a plastic strip comprised of the back panel 20 and front panel 18 in an initial unfolded relation is urged through lengthwise movement 26, during which the adhesive 12 is deposited therealong adjacent the back panel upper edge 16, and the release strip 14 in a continuous unattached strip form 28 placed over the adhesive deposit 12. Next, at a folding station, the front panel 18 is folded over the back panel 20 which, of course, results in the superposed folded relation of the bag rear and front panels work-in-process configuration 30 and, pertinent to the within invention, the unavoidable interposed position of the release strip 14 at the spaced transverse locations 32 which coincide with the opposite side edges 34 of each bag 10. Thus, when next a known heat sealing and transverse cutting bag-manufacturing component is applied at the locations 32, the heat sealing along the bag side edges 34 are only for the distances 36 since the heat sealing for the remaining upper distances 38 is inhibited by the interposed release strip 14.

Figure 3:
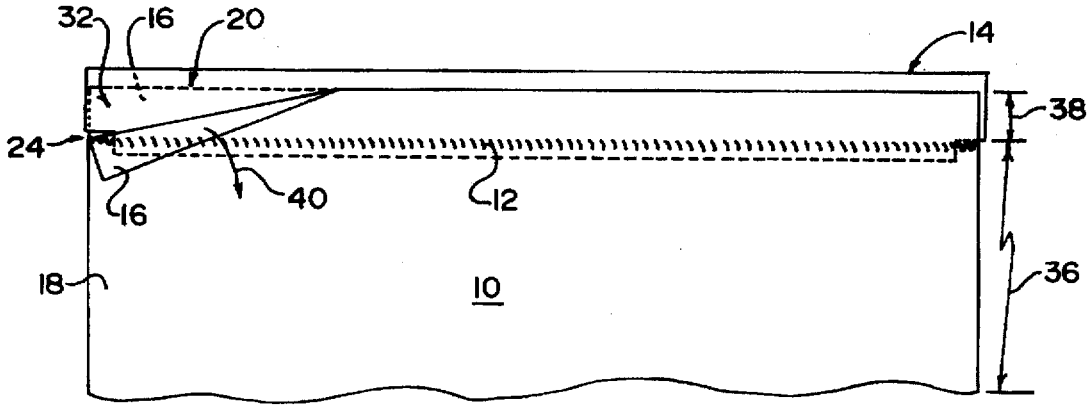
FIG. 3 PRIOR ART
FIG. 3 is an enlarged partial front elevational view of the plastic bag formed in accordance with the prior art method of FIG. 1.

As shown in FIG. 3, the prior art front bag upper edge 16 is unsealed along the distance 38 and is thus vulnerable to delamination when pulled or otherwise urged through movement in the direction 40.

Figure 2:
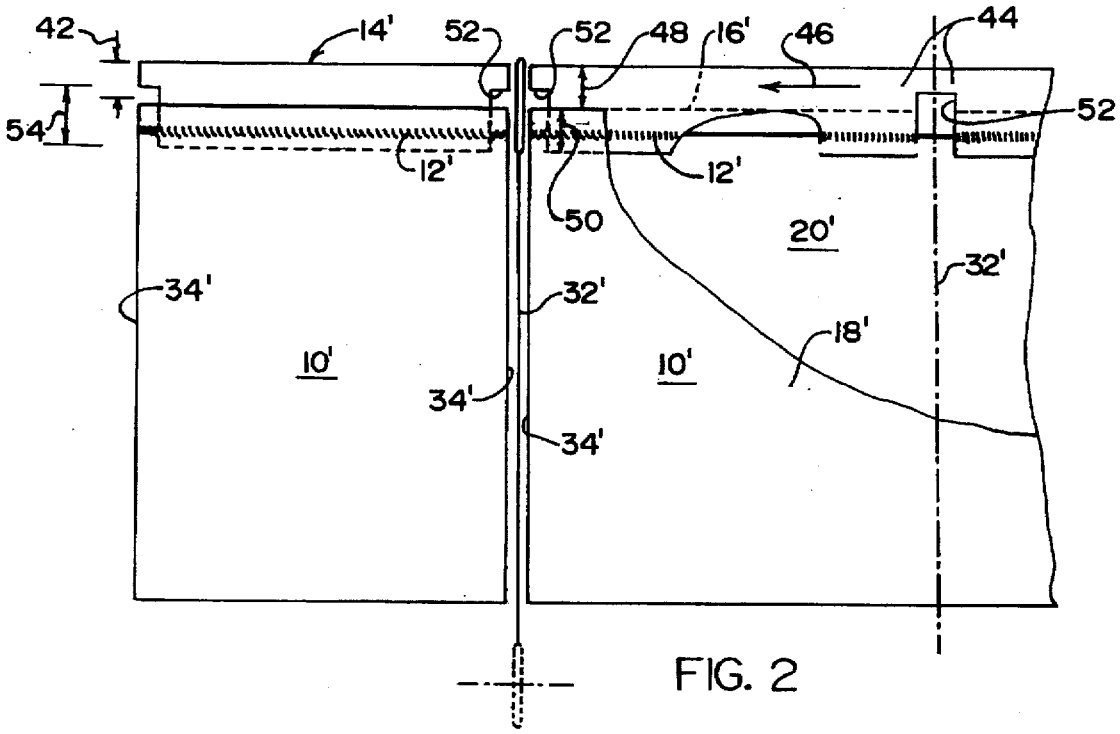
FIG. 2 is a similar front elevational view of manufactured side by side plastic bags wherein each embody structural features in accordance with the present invention.
Figure 4:
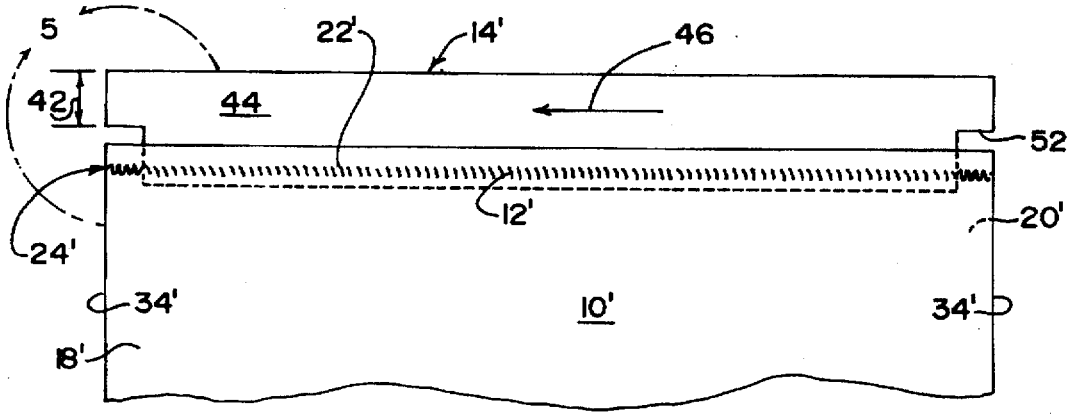
FIG. 4 is similarly an enlarged partial front elevational view but of the within inventive plastic bag.
Figure 5:
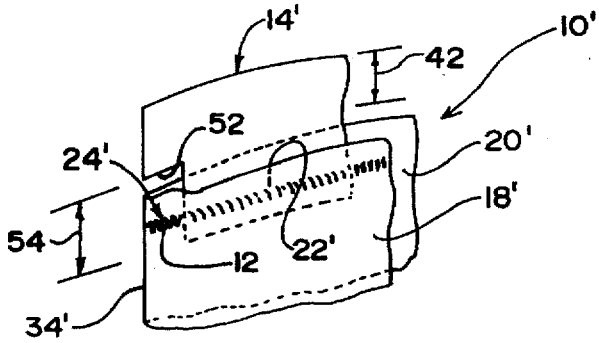
FIG. 5 is a detailed view as taken within the area denoted by the arrows 5—5 of FIG. 4 of the within inventive plastic bag illustrating the improved structural features thereof.

Underlying the present invention is the recognition that successive side by side plastic bags, but with full transverse side heat sealed edges can be formed in accordance with prior art practice, as just described, by modifying slightly only the release strip, as will now be better understood in connection with FIGS. 2, 4 and 5.

In said FIGS. 2, 4 and 5 product attributes of the manufactured plastic bag, except for the release strip and the benefits derived therefrom are identical to those already described in connection with FIGS. 1 and 3 and, to denote this carryover, these product attributes are identified by the same, but primed, reference numerals and, for brevity's sake and as not necessary for an understanding of the present invention will not be repeated. It suffices to note that to urge the release strip 14' in lengthwise movement as is necessary in order to use the prior art method of manufacturing successive side by side plastic bags 10', that the release strip 14' is embodied with an increased height dimension 42 which functions in the nature of an interconnected continuous strip 44 which can be pulled in the machine direction 46 from a supply roll of release strip material (not shown) and placed in covering relation over a previously applied adhesive deposit 12' in adjacent position just below the rear panel 20' upper edge 16' which bounds the bag opening 22'. As a consequence, when the bag front panel 18' is folded over the bag rear panel 20', the increase in dimension of the release strip 14' results in the release strip upper portion 48 extending outwardly of the bag upper edges 16' and the lower portion 50 disposed in an interposed position therebetween. To obviate the lower portion 50 from inhibiting heat sealing at the top length portions 50 of the bag side edges 34', the release strip 14' prior to use for bag manufacturing is die cut or otherwise embodied with downwardly facing rectangularly shaped notches 52 at spaced intervals selected to coincide with the bag side edges 34'. The height of the notches is of a dimensional extent 54 to extend above the tops of the bag upper edges 16', so that the combination heat seal and severance cuts along the transverse locations 32' does not inhibit heat sealing in the upper length portions 50', as was the case in the manufacture of the plastic bags 10 of FIGS. 1 and 3. In the within inventive bags 10', as best shown in FIG. 5, there is significantly less vulnerability for delamination or separation of the panels 18' and 20' from each other along the heat sealed sides 34', all to the end of contributing to providing a more effective adhesive closure 24' for hermetically sealing the plastic bag 10' and thus permitting the use of the bag for storing and handling infectious medical and like waste materials.

While the plastic bag and the method of its manufacture herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of successively forming in side by side relation plural plastic bags each having a widthwise oriented adhesive deposit along a top edge of each bag with a release strip in covering relation thereover and in an interposed position between overlying upper edges of a bag front panel and a bag rear panel bounding an opening into said bag wherein removal of said release strip is adapted to provide an adhesive closure for said bag opening, said method of forming said plastic bags comprising the steps of preparing said release strip with a height sized in said interposed position thereof between upper edges of said bag front and rear panels to have an upper length portion thereof extending outwardly in the plane of said bag front and rear panels, notching a downwardly facing rectangular shape having spaced apart vertically oriented side edges and a connecting horizontally oriented upper edge in a lower portion of said release strip at spaced locations therealong adapted to coincide with side edges of said successive plastic bags, depositing an adhesive on successive bag rear panels, positioning said notched release strip in covering relation over said adhesive deposit with said upper edge in a clearance position above said upper edges of said front and rear panels, folding successive bag front panels over said bag rear panels and against an uncovered adhesive deposit in each said release strip notch, and heat sealing at transverse spaced intervals coinciding with said release strip notches said front and rear panels to each other to form side edges of said successive plastic bags, whereby each bag has heat sealed side edges for the entire length thereof.

* * * * *